US005109550A

United States Patent [19]

Makita et al.

[11] Patent Number: 5,109,550

[45] Date of Patent: May 5, 1992

[54] FLUSH WATER SUPPLY SYSTEM FOR TOILET STOOL

[75] Inventors: Atsuo Makita; Hirofumi Takeuchi; Shinji Shibata; Noboru Shimbara, all of Kanagawa, Japan

[73] Assignee: Toto Ltd., Fukuoka, Japan

[21] Appl. No.: 713,120

[22] Filed: Jun. 10, 1991

Related U.S. Application Data

[62] Division of Ser. No. 502,063, Mar. 29, 1990, Pat. No. 5,052,060.

[30] Foreign Application Priority Data

Mar. 30, 1989 [JP] Japan ..... 1-79358

[51] Int. Cl.[5] ..... E30D 1/00; E30D 1/24

[52] U.S. Cl. ..... 4/300; 4/329

[58] Field of Search ..... 4/DIG. 3, 425, 427, 4/313, 329, 300; 137/624.11, 624.14, 876, 625.32, 862, 614.13, 614; 251/128.11, 304

[56] References Cited

U.S. PATENT DOCUMENTS

| | | | |
|---|---|---|---|
| 1,928,717 | 10/1933 | Campus . | |
| 3,010,115 | 11/1961 | Wiggs | 4/300 |
| 3,086,217 | 4/1963 | Barlow | 4/425 |
| 3,224,013 | 12/1965 | Tubbs . | |
| 3,482,601 | 12/1969 | Drouin | 137/876 |
| 4,086,668 | 5/1978 | Tubbs | 137/846 |

FOREIGN PATENT DOCUMENTS

| | | |
|---|---|---|
| 2840580 | 3/1979 | Fed. Rep. of Germany . |
| 1340355 | 9/1963 | France . |
| 2430438 | 2/1980 | France . |
| 30092 | 7/1980 | Japan . |

*Primary Examiner*—Ernest G. Cusick
*Assistant Examiner*—David J. Walczak
*Attorney, Agent, or Firm*—Merchant, Gould, Smith, Edell, Welter & Schmidt

[57] ABSTRACT

A flush water supply system comprising a passageway valve mounted in a pipeline for supplying flush water to a toilet stool, and a control circuit for controlling the closing and opening of the passageway valve. A constant flow valve is mounted in the pipeline for keeping a predetermined amount of discharge flow, irrespective of water supply pressure.

25 Claims, 8 Drawing Sheets

FLUSH WATER SUPPLY SYSTEM FOR TOILET STOOL

This is a division of application Ser. No. 07/502,063, filed Mar. 29, 1990. Now U.S. Pat. No. 5,052,060.

BACKGROUND OF THE INVENTION

1. Field of the invention

This invention relates to a flush water supply system for controlling the supplying of flush water to a toilet stool, and more particularly to such a system for controlling the flush water supply to the toilet stool by operating an electrically operable valve mounted in a supply pipe.

2. Description of the Related Art

Heretofore, flush systems are widely used in which flush water is temporarily stored in a tank and is then discharged over the bowl of a toilet stool at need. A common problem with the conventional flush systems is that a relatively large space is required for installation of the tank. To this end, a solution has been disclosed in Japanese Patent Publication No. 30092/1980, in which an electrically operable valve is mounted in a supply pipe and is driven under the control of a control unit to supply flush water to the toilet stool directly, i.e. not via any tank.

In this prior system, the supply pipe is branched into two branch pipelines, and a pair of electromagnetic valves is mounted one in each of the branch pipelines for supplying flush water to a bowl of the toilet stool and also to a jet nozzle. As a flush start switch, for example, is operated, the control unit drives the individual electromagnetic valves in a preset order to an opened position for a predetermined period of time to supply flush water to the bowl.

However, this prior system has the following problem especially in controlling the amount of supply of flush water by varying the time duration of opening the individual electromagnetic valves.

The supply pressure of the supply pipe depends on the position of installation of the toilet stool; therefore, with constant time duration used for opening the electromagnetic valves, if the supply pressure is relatively high, the amount of supply of flush water would be excessive so that the sound of flushing is increased to create a splash as well as being undesirable from the viewpoint of saving water. And if the supply pressure is relatively low, the amount of supply of flush water would be insufficient and would cause incomplete flushing of the toilet stool.

It could be considered to provide the control unit with the function of adjusting the time duration of supplying flush water, and to thereby set the time duration of water supply individually depending on the supply pressure at the position of installation of the toilet stool. This hypothetical control unit is complex in structure and additionally has the following problems.

Partly since the supply pressure of the supply pipe would occasionally be different between day and night, and partly since it temporarily varies as another water spigot is turned on, it is difficult to keep the amount of supply of flush water within a predetermined range without being influenced by the fluctuation of the supply pressure

SUMMARY OF THE INVENTION

It is therefore an object of this invention to provide a flush water supply system, for a toilet stool, in which a predetermined amount of flush water can be supplied to the toilet stool without being influenced by the change of the supply pressure.

According to a first aspect of this invention, there is provided a flush water supply system for a toilet stool, comprising: a pipeline means for supplying flush water to the toilet stool; a constant flow valve mounted in said pipeline means for obtaining a predetermined amount of discharge flow, irrespective of water supply pressure above a minimum; a valve mounted in said pipeline means and electrically operable; a starting-of-flushing input means for accepting an input for starting the supply of flush water; and a control means for driving said valve in response to the input for starting the supply of flush water, and for keeping said valve in an opened position for a preset period of time.

With the first arrangement, because the discharge rate is held substantially constant by the constant flow valves, irrespective of variations in the water supply pressure, above a minimum, a predetermined amount of flush water can be supplied to the toilet stool by simply setting the duration of opening of the individual opening/closing valves. Therefore, it is possible to flush the toilet stool reliably by an appropriate amount of water, without adjusting the interval that the opening/closing valves are open and without any excessive or insufficient supply to the toilet stool due to the temporary fluctuation of the supply pressure.

According to a second aspect of the invention, there is provided a flush water supply system for a toilet, comprising: a toilet stool having a plurality of supply ports; a pipeline means for supplying flush water to said toilet stool, said pipeline means including a plurality of branched pipelines each having an end connected to a respective one of said supply ports of said toilet stool; a constant flow valve mounted in said pipeline means upstream of said branched pipelines for obtaining a predetermined amount of discharge flow, irrespective of water supply pressure; a plurality of electrically operable valves mounted one in each of said branched pipelines; a starting-of-flushing input means for accepting an input for starting the supply of flush water; and a control means for driving the second-named valves in a preset order in response to the input for starting the supply of flush water, and for keeping said valve in an opened position for a preset period of time.

According to a third aspect of the invention, there is provided a flush water supply system for a toilet, comprising: a toilet stool having a plurality of supply ports; a pipeline means for supplying flush water to the toilet stool, the pipeline means including a waterway change-over valve having a plurality of discharge ports, and a plurality of pipelines each communicating between a respective one of the discharge ports of the waterway change-over valve and a corresponding one of the support ports of the toilet stool; a constant flow valve mounted in the pipeline means upstream of the waterway change-over valve for obtaining a predetermined amount of discharge flow, irrespective of water supply pressure; an electrically operable valve mounted in the pipeline means upstream of the waterway change-over valve; a starting-of-flushing input means for accepting an input for starting the supply of flush water; and a control means for driving the waterway change-over valve and the third-named valve in response to the input for starting the supply of flush water.

With the second and third arrangements, since flush water of amounts each corresponding to the duration of opening the individual one of the opening/closing valves is supplied to a plurality of water-supply ports of the toilet stool, it is possible to supply a necessary amount of water to each of the water-supply ports. For example, it is possible to set the amount of supply to the bowl for preliminary flushing, the amount of supply to the jet nozzle and the amount of supply to the bowl for water seal to individual optimum values, thus saving water and guaranteeing an effective flushing of the toilet stool.

According to a fourth aspect of the invention, there is provided a flush water supply system for a toilet, comprising: a toilet stool having a plurality of supply ports; a pipeline means for supplying flush water to the toilet stool, the pipeline means including a waterway change-over valve means having a plurality of discharge ports, and a plurality of pipelines each communicating between a respective one of the discharge ports of the waterway change-over valve means and a corresponding one of the support ports of the toilet stool; a constant flow valve mounted in the pipeline means upstream of the waterway change-over valve means for obtaining a predetermined amount of discharge flow, irrespective of water supply pressure, the waterway change over valve being capable of opening and closing the flow waterway; a starting-of-flushing input means for accepting an input for starting the supply of flush water; and a control means for driving the waterway change-over valve means to make a change-over and to open or close, in response to the input for starting the supply of flush water.

With the fourth arrangement, since the waterway change-over valve with the water flow stopping function is disposed on the downstream side of the constant flow valve(s), it is possible to supply predetermined amounts of flush water respectively to a plurality of water-supply ports by a reduced number of valve mechanisms, irrespective of the water supply pressure.

According to a fifth aspect of the invention, there is provided a flush water supply system for a toilet, comprising: a toilet stool having a plurality of supply ports; a pipeline means for supplying flush water to the toilet stool, the pipeline means including a plurality of branch pipelines connected one to each of the supply ports of the toilet stool; a plurality of electrically operable waterway valves mounted one in each of the branch pipelines; means for differentiating the flows in the branch pipelines from one another; a starting-of-flushing input means for accepting an input for starting the supply of flush water; and a control means for driving the waterway valve means in a preset order and keeping the waterway valve means in an opened position, in response to the input for starting the supply of flush water.

With the fifth arrangement, because constant flow valves different in discharge flow can be mounted in the respective branch pipelines according to need, it is possible to set instant flow amounts independently for the individual waterways.

The above and other advantages, features and additional objects of this invention will be manifest to those versed in the art upon making reference to the following detailed description and the accompanying drawings in which several structural embodiments incorporating the principles of this invention are shown by way of illustrative example, in which:

DETAILED DESCRIPTION

Various embodiments of this invention will now be described with reference to the accompanying drawings.

Figure 1:
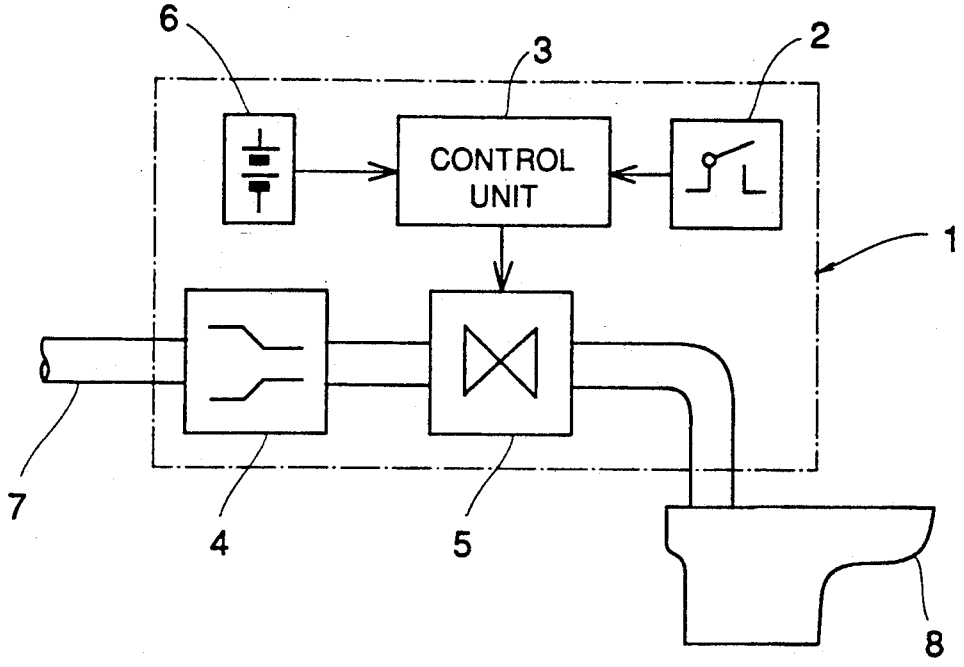
FIG. 1 is a block diagram showing a flush water supply system of a toilet stool according to a first embodiment of this invention.

FIG. 1 shows a flush water supply system (hereinafter called "system") 1, for a toilet stool, according to the first embodiment of this invention.

The system 1 generally comprises a flush start switch 2, a control unit 3, a constant flow valve 4, an opening/closing valve 5, and a power source 6. The power source 6 may be a battery. A supply pipe 7 is connected to a toilet stool 8 via the constant flow valve 4 and the opening/closing valve 5. The connecting order of the constant flow valve 4 and the opening/closing valve 5 may be reversed.

The control unit 3 receives a supply of electric power from the power source 6 and is operable, as the flush start switch 2 is switched on, to issue an output for driving the opening/closing valve 5 to an opened position for a predetermined period of time. The control unit 3 may be composed of a timer circuit operable to start according to a flush start input signal from the flush start switch 2, and a drive circuit for amplifying the electric power of the output of the timer circuit to drive the opening/closing valve 5.

The opening/closing valve 5 may be an electromagnetic valve. Separately from the electromagnetic valve using an electromagnetic solenoid, etc., a valve drivable by an actuator using a piezoelectric element may alternatively be used. Alternatively, the opening/closing valve 5 may be a self-maintaining valve. With a self-maintaining latching-type electromagnetic valve, the control unit 3 generates a valve-opening pulse and a valve-closing pulse to control the opening/closing of the valve at a required timing. Further, with the self-maintaining valve of multi-step driving type in which the duration of opening of the valve is controlled depending on the number of pulses applied, the control unit 3 generates a required number of valve opening or valve-closing pulses to control the valve. Still further, with the self-maintaining valve of step-free or continuously driving type in which the amount of opening of the valve is controlled depending on the amplitude of the electrical signal applied, the control unit 3 controls so as to supply electricity commensurate with the required amount of opening of the valve.

Figure 2:
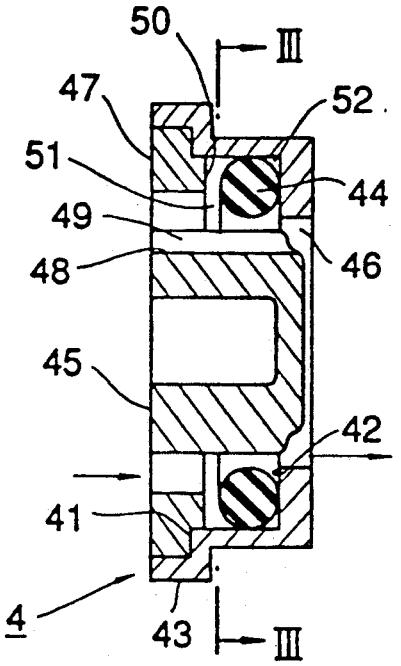
FIG. 2 is a vertical cross-sectional view of a constant flow valve of FIG. 1.
Figure 3:
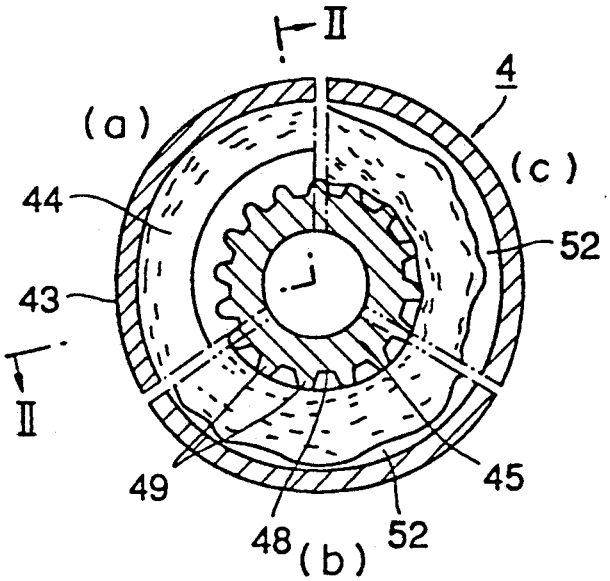
FIG. 3 is a cross-sectional view taken along line III—III of FIG. 2, showing the structure and operation of the constant flow valve.

As shown in FIGS. 2 and 3, the constant flow valve 4 is composed of a cylindrical case 43 reduced in diameter at step portions 41, 42 in the direction of water flow, a throttle ring 44 attached to the downstream step portion 42 inside the case 43, and an inner wall member 45.-fitted in the upstream step portion 41 of the case 43.

In the constant flow valve 4, the large diameter side is the flow-in side, while the reduced diameter side is the discharge side; flush water, as indicated by the arrows in FIG. 2, flows from the flow-in side toward the discharge side through the space between the throttle ring 44 and the outer circumferential surface of the inner wall member 45. The throttle ring 44 is circular in cross section and is made of a packing material. The inside diameter of the throttle ring 44 is, in free form, substantially equal to the diameter (diameter of the discharge port) of an opening 46 of the downstream step portion 42.

The inner wall member 45 includes an annular frame portion 47 engaging the upstream step portion 41 of the case 43, and a bottomed tubular inner wall 48 connected with the annular frame portion 47 by a plurality of connecting portions (not shown) extending radially inwardly from the annular frame portion 47. On the outer circumferential surface of the inner wall 48, a plurality of projections 49 are formed in the shape of a gear in the direction of water flow. The outside diameter of the gear-shaped projections 49 is slightly smaller than the inside diameter of the throttle ring 44. A gap 51 is defined between the throttle ring 44 and the downstream end surface 50 of the annular frame portion 47 so that flush water can flow into the space 52 between the outer circumferential surface of the throttle ring 44 and the inner circumferential surface of the case 43.

Consequently, as shown at circumferential region (a) in FIG. 3, if the water pressure at the flow-in side is low, the throttle ring 44 remains in its initial shape to keep a predetermined gap between the throttle ring 44 and the inner wall 48. As the supply pressure progressively increases, as shown at circumferential regions (b) and (c) of FIG. 3, due to the pressure of water flows into the space 52 between the outer circumferential surface of the throttle ring 44 and the inner circumferential surface of the case 43, the throttle ring 44 is deformed so as to become reduced in diameter, thus progressively narrowing the gap between the throttle ring 44 and the inner wall 48.

Figure 4:
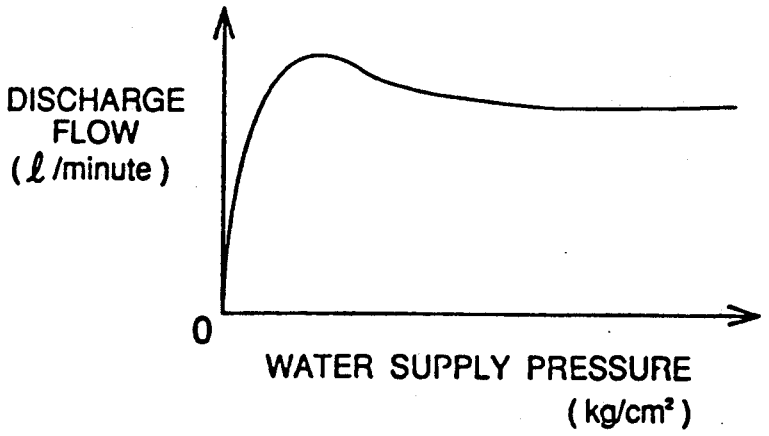
FIG. 4 is a graph showing a supply pressure-discharge-flow characteristic of the constant flow valve of FIGS. 2 and 3.

As a result, it is apparent from the graph of FIG. 4 that when the water supply pressure (x coordinate axis) climbs over a predetermined value, the amount of discharge flow (y coordinate axis) is limited to a substantially constant value.

In the system 1 of FIG. 1, since with the constant flow valve 4 having the discharge flow characteristic of FIG. 4, the discharge flow is kept substantially constant irrespective of the water supply pressure of the supply pipe 7, it is possible to supply to the toilet stool 8 a predetermined amount of flush water only by setting the time duration of opening of the valve 5.

Figure 5:
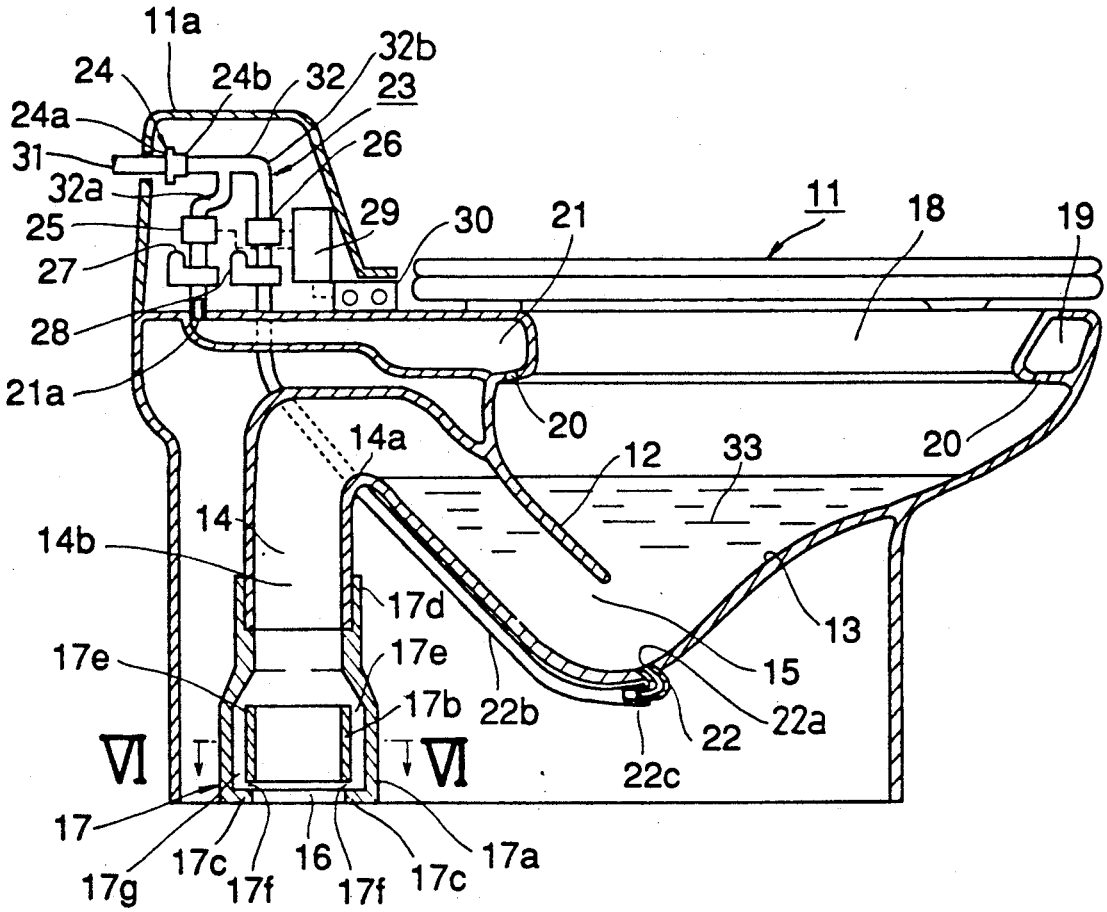
FIG. 5 is a vertical cross-sectional view showing a toilet stool equipped with a modified flush water supply system according to a second embodiment.

FIG. 5 shows a toilet stool 11 equipped with a modified flush water supply system according to the second embodiment.

This toilet stool 11 is a siphon jet type. The toilet stool II includes a bowl 13 divided by a partition wall 12, and a trap drainage 14. The trap drainage 14 is bent in a generally inverted U-shape and communicates at one end with a flow-in port 15 disposed in the lower rear wall of the bowl 13 and at the other end with a flow-out port 16 in the rear bottom surface of the toilet stool 11. The trap drainage 14 has a substantially vertical drain tube **14*b* downstream of a barrage 14*a*. A water seal generating mechanism 17 independent of the toilet stool 11 is provided on the drain tube 14*a* downstream of a substantially mid portion of the drain tube 14*b***.

This water seal generating mechanism 17 includes a tubular body having at a substantially central portion an enlarged inside diameter to provide an enlarged-diameter tube **17*a* downstream thereof, a sewage guide tube 17*b* disposed in the enlarged-diameter tube 17*a* concentrically thereof, and a reduced-diameter end portion 17*c* disposed at the lower end of the water seal generating mechanism 17. Also, the water seal generating mechanism 17 has at its upper end a connecting tube 17*d* fitted in the trap drainage 14 of the toilet stool 11** and fixedly secured thereto fluidtightly by packing, adhesive, etc.

Figure 6:
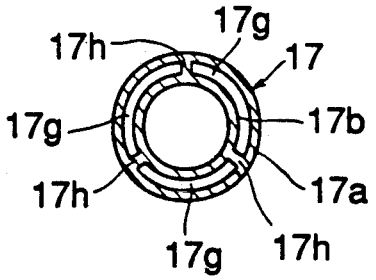
FIG. 6 is a cross-sectional view taken along line VI—VI of FIG. 5.

There are defined respective gaps **17*e*, 17*f*, 17*g* between the upper end of the sewage guide tube 17*b* and the inner wall surface of the enlarged-diameter tube 17*a*. The sewage guide tube 17*b*, as shown in the horizontal cross-sectional view of FIG. 6, is fixedly secured within the enlarged-diameter tube 17*a* at three connecting portions 17*h***.

Accordingly, a partial flush water flowing in the drain tube **14*b* enters the gap 17*g* between the enlarged-diameter tube 17*a* and the sewage guide tube 17*b*, and is then sprayed from the gap 17*f* between the reduced-diameter end portion 17*c* and the lower end of the sewage guide tube 17*b* toward the center of the sewage guide tube 17*b* to create an efficient water seal at the flow-out port 16**.

In the meantime, the sewage to be conveyed, along with flush water, in the trap drainage 14 passes inside the sewage guide tube **17*b* and is then discharged from the flow-out port 16** to a non-illustrated discharge pipe.

In the rim 18 along the upper end peripheral edge of the bowl 13, a waterway 19 is defined in an annular form so as to project inwardly of the bowl 13. The bottom of this annular waterway 19 has a plurality of watershooting holes 20 at a desired spacing, each watershooting hole 20 being inclined with respect to the bowl 13. The annular waterway 19 is communicating at its rear portion with a water-supply chamber 21.

A jet nozzle 22 is fluidtightly attached to the bottom of the bowl 13, and has a jetting hole 22*a* pointing to the flow-in port 15 of the trap drainage 14.

The toilet stool 11 has at its rear upper position a box 11*a* in which a flush water supply system 23 is accommodated The system 23 comprises a constant flow valve 24, opening/closing valves 25, 26 for water supply to the rim 18 and the jet nozzle 22, open-to-atmosphere valves 27, 28, a control unit 29, and an operation unit 30 for giving a flush start input to the control unit 29. The open-to-atmosphere valves 27, 28 here comprise typical "vacuum breakers" such as are widely used in plumbing systems. A vacuum breaker has an end chamber with openings to atmosphere, and a loose, sliding, interior valve member which normally is kept closed by water pressure in the system. If there is a suction in the water line, however, the sliding valve member is pulled away from its valve seat and the line is opened to atmosphere.

A supply pipe 31 is connected to the flow-in side of the constant flow valve 24, and a branched pipeline 32 is connected to the discharge side 24*b* of the constant flow valve 24. The opening/closing valve 25 and the open-to-atmosphere valve 27 are disposed centrally in one branch 32*a* of the branched pipeline 32, which branch is connected to a water supply port 21*a* of the supply chamber 21. The opening/closing valve 26 and the open-to-atmosphere valve 28 are disposed centrally in the other branch 32*b* of the branched pipeline 32, which branch is connected to a water supply port 22*c* of the jet nozzle 22 via a jet waterway 22*b*. The jet waterway 22*b* is made of metal, synthetic resin or synthetic rubber.

FIGS. 7 through 10 show the structure and operation of the constant flow valve 24.

The constant flow valve 24 is composed of a housing 62 inserted in and secured to a waterway 61, a core member 63 engaged within the housing 62, and a elastic O-ring 64. The housing 62 is in the form of a cylinder having, in its upstream open end, a first step portion 65 for engagement with the core member 63 when the housing 62 is inserted in the waterway 61 and also having, in the downstream open end, a second step 66 for engagement with the O-ring 64.

The core member 63 is in the form of a warhead or bullet nose and has at its rear end a flange 68 having a waterpassage hole 67 and on its peripheral surface a plurality of axial projections 69. As the flange 68 of the core member 63 is engaged with the first step portion 65 of the housing 62, the distal end of the core member 63 is loosely inserted in the inner circumferential surface of the second step portion 66 to project from the housing 62.

The O-ring 64 is loosely received between the inner circumferential surface of the housing 62 and the outer circumferential surface of the core member 63, and is in engagement with the second step 66 of the housing 62

The flush water flowing in the waterway 61 passes through the water-passage hole and a gap 70 between the core member 63 and the O-ring 64, and then flows to the downstream side via the second step portion 66 and the core member 63.

Figure 7:
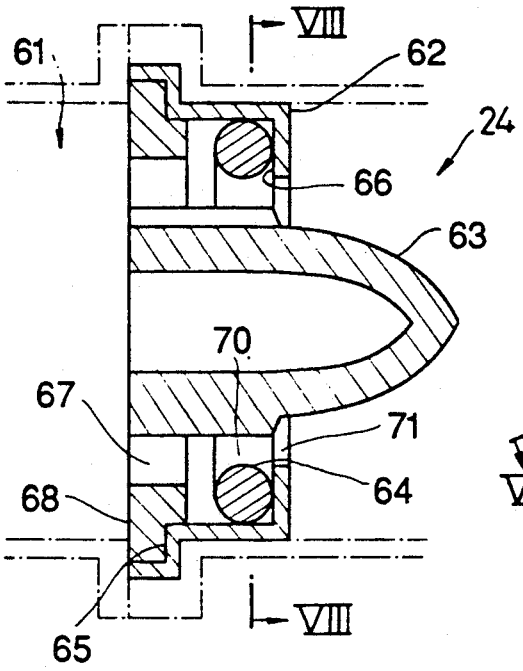
FIG. 7 is a vertical cross-sectional view of a modified constant flow valve.
Figure 8:
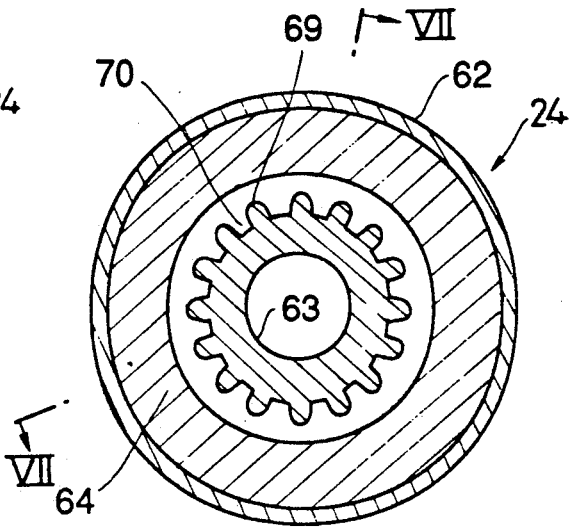
FIG. 8 is a cross-sectional view taken along line VIII—VIII of FIG. 7.
Figure 9:
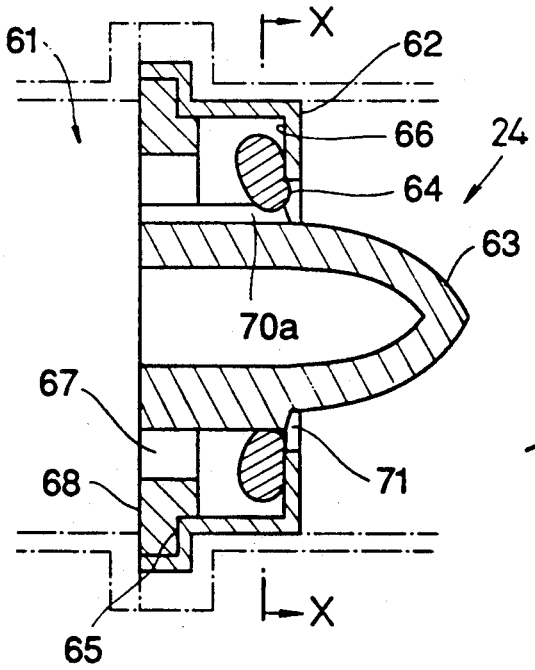
FIG. 9 is a view similar to FIG. 7, showing the constant flow valve when the supply pressure is high.
Figure 10:
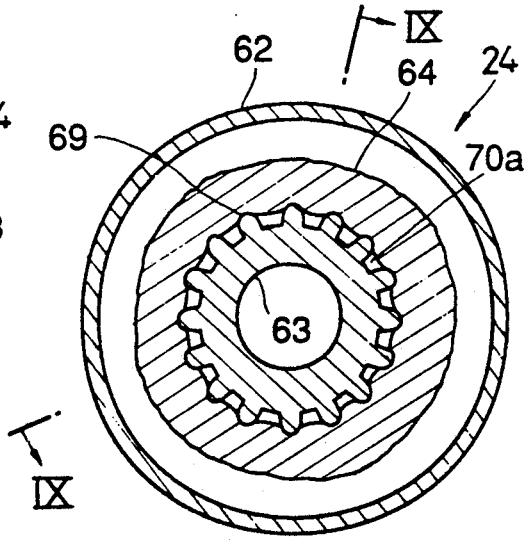
FIG. 10 is a cross-sectional view taken along line X—X of FIG. 9.

At that time, when the water supply pressure to the waterway 61 is low, as shown in FIGS. 7 and 8, the O-ring 64 is free from deforming forces so that the gap 70 between the O-ring 64 and the core member 63 establishes a predetermined area of water passage. As described above in connection with the first embodiment, when the supply pressure is high, the O-ring 64 is deformed under compression against the second step portion 66 under this high pressure, as shown in FIGS. 9 and 10, thus reducing the area of water passage of the gap 70 between the O-ring 64 and the core member 63.

The deformation of the O-ring 64 is such that the higher the water supply pressure, the smaller the area of water passage becomes, thus reducing the amount of water passage for that pressure, and equalizing the flow rates. FIGS. 9 and 10 show the state in which the gap 70 between the O-ring 64 and the core member 63 is left only in a plurality of grooves 70*a* between the axial projections 69 on the core member 63.

Figure 11:
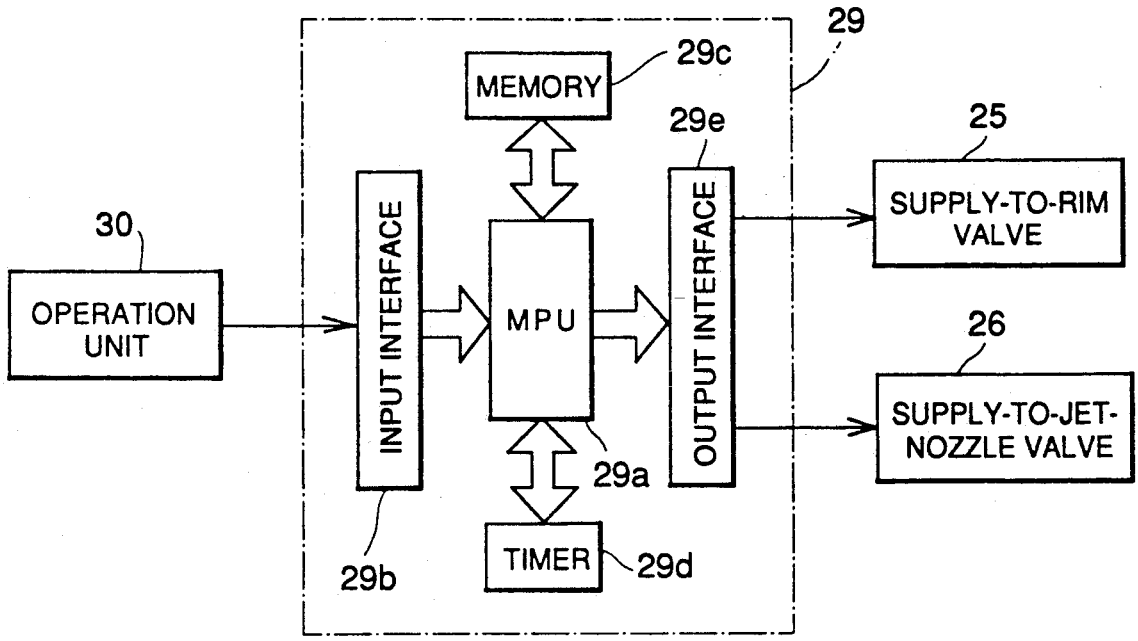
FIG. 11 is a block diagram of a control unit.

As shown in FIG. 11, the control unit 29 includes a microprocessor unit (hereinafter called "MPU") 29*a*, an input interface circuit 29*b*, a memory 29*c*, a timer 29*d*, and an output interface circuit 29*e*.

The operation unit 30 is equipped with a switch for starting the flushing of the toilet stool 11.

Alternatively, the operation unit 30 may be equipped with a plurality of switches for changing over the amount of supply of flush water between flushing of solid excrement and flushing of liquid excrement. Further, a switch or sensor for detecting when the user is seated may be used; an output signal of the switch or sensor may be inputted to the control unit 29 so that the operation unit 30 is effective only when seated, or so that flushing is started after a lapse of a predetermined time after the user have shifted from the seated posture to the unseated posture.

The opening/closing valves 25, 26 for flush water supply to the rim 18 and the jet nozzle 22, respectively, are each usable when a predetermined voltage is impressed. A latching solenoid type of electromagnetic valve may be used which is equipped with starting and returning windings; pulses are issued only when starting and returning, to open and close the valve.

Figure 12:
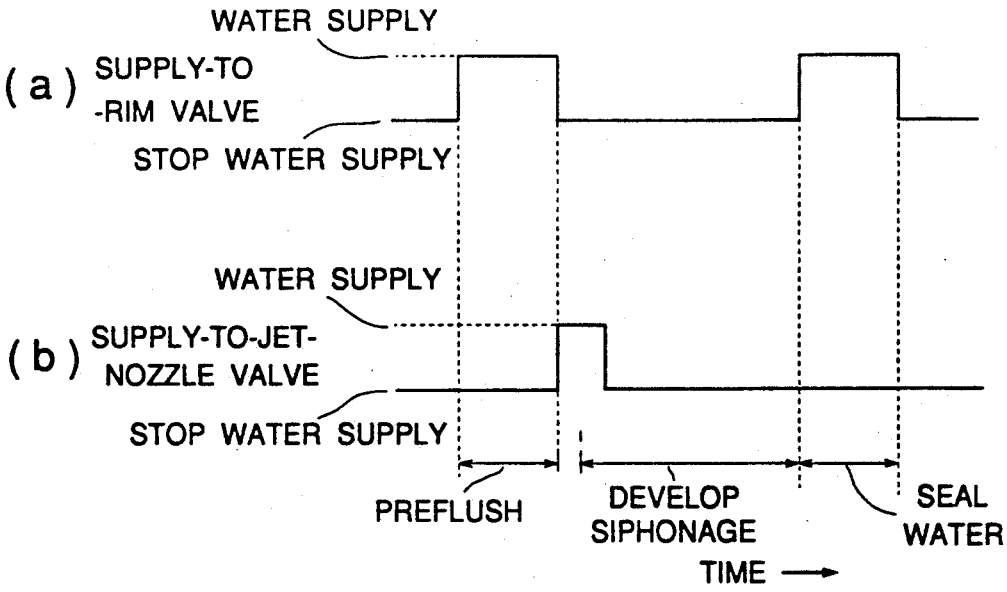
FIG. 12 is a timechart showing the operation of the control unit.

With this construction, when a flush start input is given from the operation unit 30, the opening/closing valve 25 for the supply of flush water to the rim 18 is opened for a predetermined period of time, as shown in FIG. 12, so that flush water is supplied from the watershooting holes 20 to the bowl 13 via the waterway 19. Then as the opening/closing valve 25 is closed, and as the opening/closing valve 26 is opened for a predetermined period of time, flush water is sprayed from the jet nozzle 22 into the trap drainage 14.

The flush water sprayed into the trap drainage 14 flows over the barrage 14*a* to the drain tube 14*b* so that a water film is created in the reduced-diameter end portion 17*c* of the water seal generating mechanism 17, at which time air in the trap drainage 14, along with the flush water, is discharged from the flow-out port 16 to a non-illustrated discharge tube. Consequently, a negative pressure is created in the trap drainage 14, an the standing water 33 in the bowl 13 is introduced into the trap drainage 4 so that the trap drainage 14 is filled with flush water to assume a state of perfect siphon.

Meanwhile, even when the opening/closing valve 26 for the supply of flush water to the jet nozzle 22 assumes a closed state, the action of siphon in the trap drainage 14 continues so that the sewage, along with the standing water 33, in the bowl 13 is discharged.

The times of opening of the opening/closing valves 25, 26 are fixed, and the amount of water flow discharging from the constant flow valve 24 is substantially constant even when the water supply pressure of the supply pipe 31 is high. Therefore, this system 23 can supply a predetermined amount of flush water to the toilet stool 11.

Figure 13:
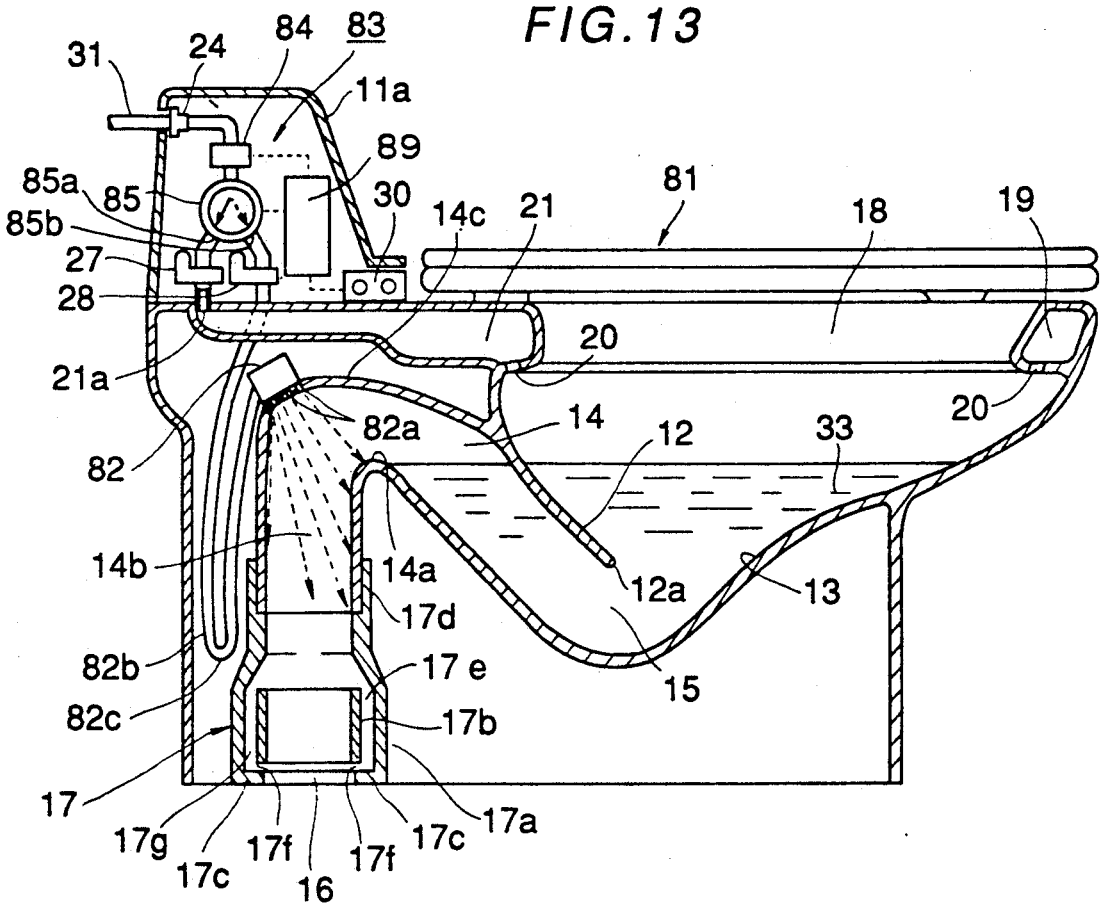
FIG. 13 is a vertical cross sectional view showing a toilet stool equipped with a modified flush water supply system according to a third embodiment.

FIG. 13 shows a toilet stool 81 which is equipped with a flush water supply system according to the third embodiment.

In the embodiment of FIG. 5, the siphon jet type toilet stool 11 has the jet nozzle 22 and the jet waterway 22*b*. Unlike the embodiment of FIG. 5, the toilet stool 81 of FIG. 13 is provided with a shower 82 for sprinkling, and a shower waterway 82*b*.

The shower 82 is attached to the rear side of the top portion 14*c* of the trap drainage 14. A plurality of sprinkling holes 82*a* of the shower 82 are arranged radially so as to point to the inner wall of the drain tube 14*b* of the trap drainage 14. The shower waterway 82*b* extends downwardly from the downstream side of the open-to-atmosphere valve 28, is turned up at 82*c* below the barrage 14*a* of the trap drainage 14, and is connected to the shower 82. The U-shaped turned-up portion 82*c* of the shower waterway 82*b* serves to seal water at the turned-up portion 82*c* and to thereby assist in preventing odors from coming out from the trap drainage 14 through the open-to-atmosphere valve 28.

Further, the system 83 has an opening/closing valve 84 disposed downstream of the constant flow valve 24, and a waterway change-over valve 85 disposed downstream of the opening/closing valve 84. In alternative form, the constant flow valve 24 may be disposed downstream of the opening/closing valve 84. The waterway change-over valve 85 has a normally open discharge port 85*a*, and a normally closed discharge port 85*b*. The normally open discharge port 85*a* is connected to the water supply port 21*a* of the water-supply chamber 21 via the open-to-atmosphere valve 27. The normally closed discharge port 85*b* is connected to the upstream side of the open-to-atmosphere valve 28. Alternatively, instead of the individual open-to-atmosphere valve 27, 28, a reverse flow preventing mechanism such as a check valve may be used.

Figure 14:
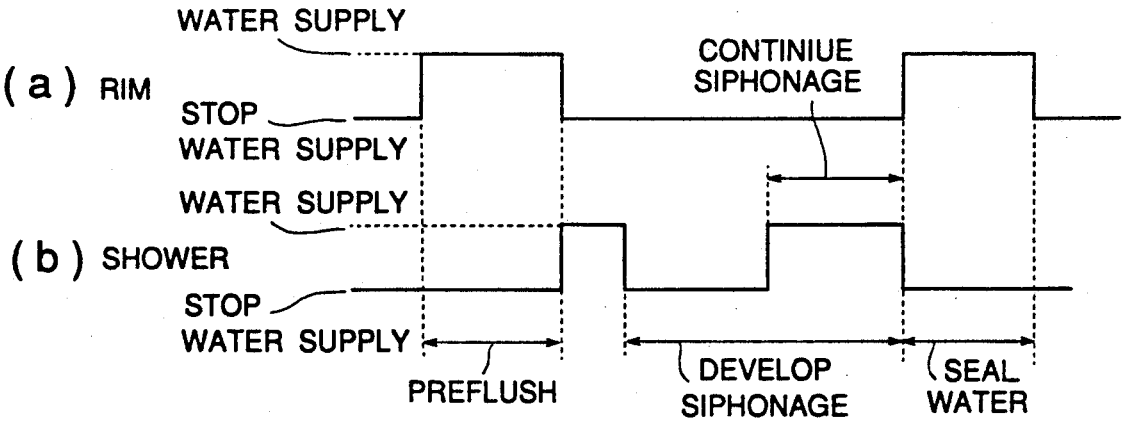
FIG. 14 is a timechart showing one example of the water supplying operation of the system of FIG.

FIG. 14 is a timechart shown one example of a flush water supplying operation of the shower-type toilet stool 81.

When a flush start input is given from the operation unit 30, the control unit 83 drives the valve 84 to assume an opened position for a predetermined period of time so that flush water is sprayed over the bowl 13 via the normally open discharge port 85*a* of the waterway change-over valve 85, the water-supply port 21*a* and the watershooting holes 20. This procedure is a so-called preliminary flushing. The control unit 83 then drives the waterway change-over valve 85 to make a change-over during the predetermined time in which the valve 84 assumes an opened position. Flush water is thereby sprinkled from the shower 82 into the drain tube 14*b* of the trap drainage 14 to discharge air, along with the flush water, in the drain tube 14*b* to a non illustrated discharge pipe. Consequently, a negative pressure is created in the trap drainage 14 so that the standing water 33 in the bowl 13 is introduced into the trap drainage 14 to fill the trap drainage 14 with flush water, i.e., in a siphon state.

With the lapse of a preset time necessary to take the action of siphoning, the control unit 83 drives the valve 84 to assume a closed position to temporarily stop supplying flush water to the shower 82. Even when the water supply to the shower 82 is stopped, the action of siphoning continues. As the level of the standing water 33 in the bowl 13 is lowered below the lower end 12*a* of the partition wall 12, air flows into the trap drainage 14 from the flow-in port 15 thereof so that the action of siphoning is suddenly stopped. In this embodiment, before the siphoning action is stopped, sprinkling from the shower 82 is conducted again to continue siphoning, thus improving the ability of conveying floating sewage in the bowl 13. The water supply to the shower 82 may be continued without any interruption.

Subsequently, the control unit 83 drives the waterway change-over valve 85 to the water-supply side again to create a water seal and to supply flush water to the bowl 13. Thus the cycle of flush water supplying operation has been completed.

Figure 15:
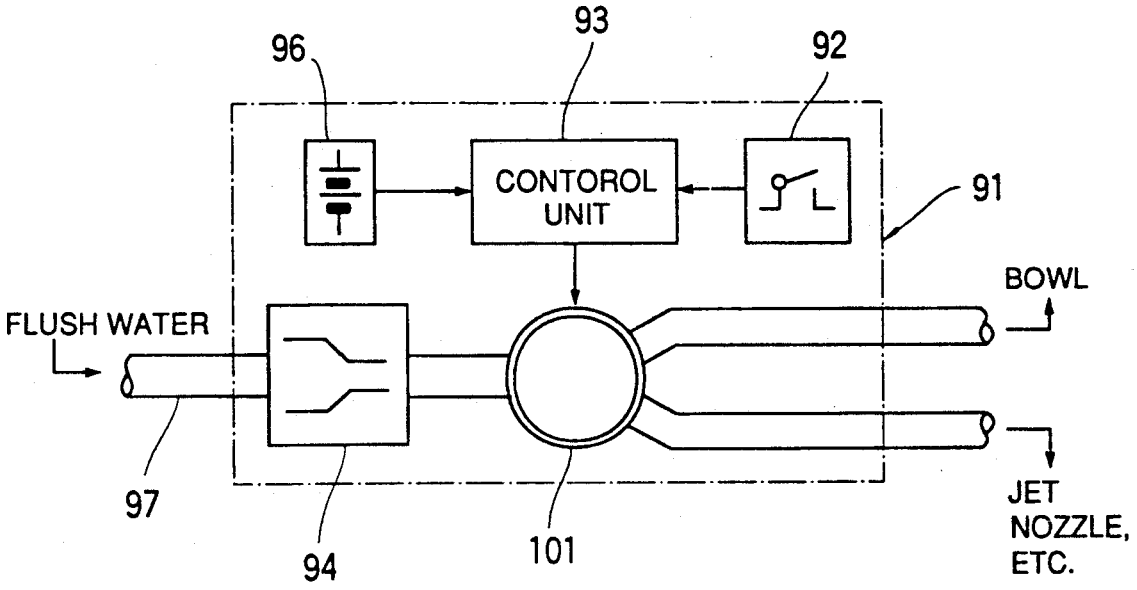
FIG. 15 is a block diagram of still another modified flush water supply system according to a fourth embodiment.

FIG. 15 shows a modified flush water supply system 91 according to the fourth embodiment.

This system 91 comprises a flush start switch 92, a control unit 93, a constant flow valve 94, a waterway change-over valve 101 with the function of stopping water flow, and a power source 96.

Figure 16:
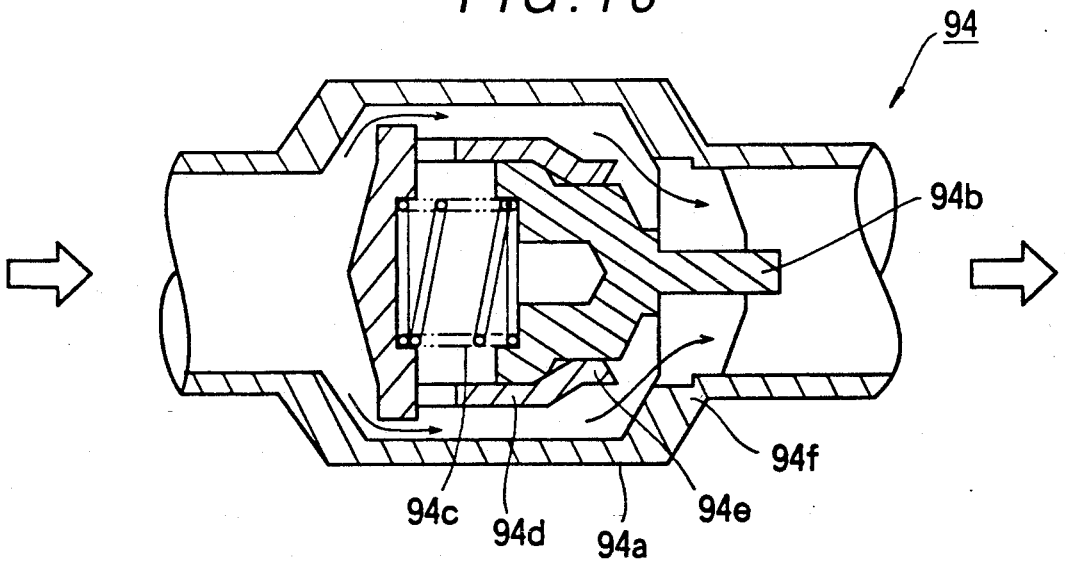
FIG. 16 is a cross-sectional view showing a constant flow valve of FIG. 15.
Figure 17:
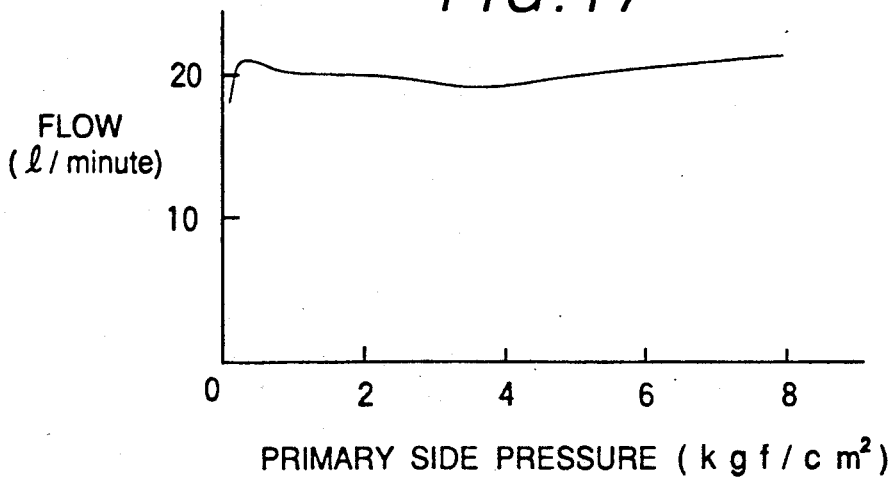
FIG. 17 is a graph showing a flow characteristic of the constant flow valve of FIGS. 15 and 16.

The constant flow valve 94, as shown in FIG. 16, includes a valve body support 94*b* mounted in the enlarged-diameter portion of a pipeline 94*a* coaxially thereof, and a valve body 94*d* fitted on the valve body support 94*b* via a spring 94*c*. Flush water flows as indicated by the arrows in FIG. 16, and the valve body 94*d* is moved downwardly to an extent commensurate with the water supply pressure. Commensurate with the water supply pressure, the gap between the downstream end 94*e* of the valve body 94*d* and a valve seat 94*f* formed in the pipeline 94*a* is narrowed so that the flow passage area thereat is reduced. Consequently, as shown in the graph of FIG. 17, the discharge flow characteristic is substantially constant, irrespective of the water supply pressure at the primary side.

Figure 18:
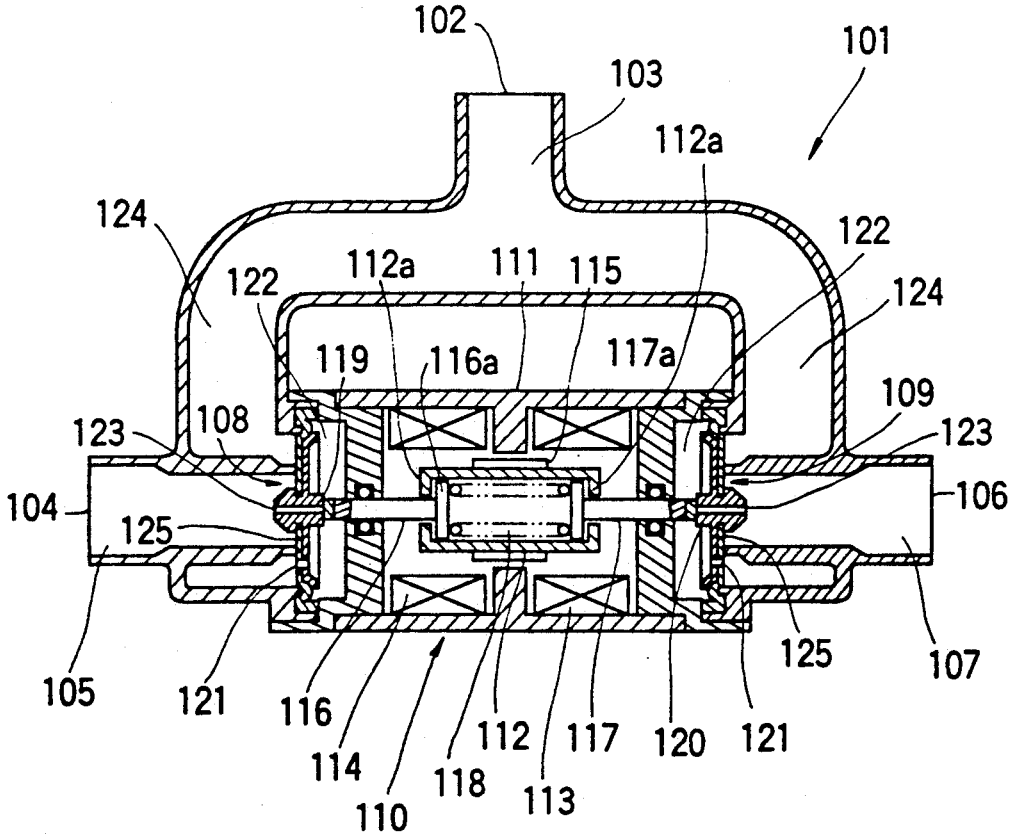
FIG. 18 is a cross-sectional view showing a waterway change-over valve equipped with the function of stopping the water supply.

The waterway change-over valve 101, as shown in FIG. 18, includes a bifurcated pipeline extending from a flow-in pipeline 103 communicating with the flow-in port 102, a first flow-out pipeline 105 communicating with the first flow-out port 104, a second flow-out pipeline 107 communicating with the second flow-out port 106, first and second pilot-type diaphragm valve mechanisms 108, 109 mounted between the first and second flow-out pipelines 105, 107, and a drive unit 110 for driving these valve mechanisms 108, 109.

The drive unit 110 is disposed in a tubular casing 111, and is composed of a axially movable plunger 112, and first and second solenoids 113, 114 for moving the plunger 112 by their electromagnetic forces. A strip of magnetic member 115 is wound around the outer circumferential surface of the plunger 112 at a axially substantially central position thereof, the individual solenoids 113, 114 being disposed axially outwardly of the magnetic member 115. Enlarged-diameter base portions 116*a*, 117*a* of first and second pilot valve bodies 116, 117 are received in the opposite ends of the plunger 112, and are normally urged toward respective pilot valve seats 119, 120 by a compression spring 118 disposed between the enlarged-diameter base portions 116, 117*a*. When the individual solenoids 113, 114 are in a deenergized state, both the two pilot valve seats 119, 120 will be closed.

Consequently, when the first solenoid 113, for example, is energized, the plunger 112 is attracted and moved toward the solenoid 113 under the electromagnetic force generated between the first solenoid 113 and the magnetic member 115. This brings the enlarged-diameter base portion 116a of the first pilot valve body 116 into contact with an inner flange of the plunger 112 so that the first pilot valve body 116 is moved rightwardly in FIG. 18 away from the pilot valve body 119. Water having filled a pressure chamber 122 via a small-diameter orifice 121 flows therefrom to the first flow-out pipeline 105 via a pilot passageway 123. And due to the pressure of a flow-in pipeline 124, the diaphragm 125 is moved toward the pressure chamber 122 so that the first pilot-type diaphragm valve mechanism 108 assumes an opened state. Thus, the flush water supplied from the flow-in port 102 flows out from the first flow-out port 104.

Likewise, when the second solenoid 114 is energized, the second pilot-type diaphragm valve mechanism 109 is operated so that flush water flows out from the second flow-out port 106.

With the system 91 of FIG. 15, since upon receipt of a flush start input, the control unit 93 drives the waterway change-over valve 101 to perform a change-over, opening and closing in a preset order for a preset period of time, it is possible to supply respective predetermined amounts of flush water to the bowl and the jet nozzle, for example, of the toilet stool in a predetermined order.

Figure 19:
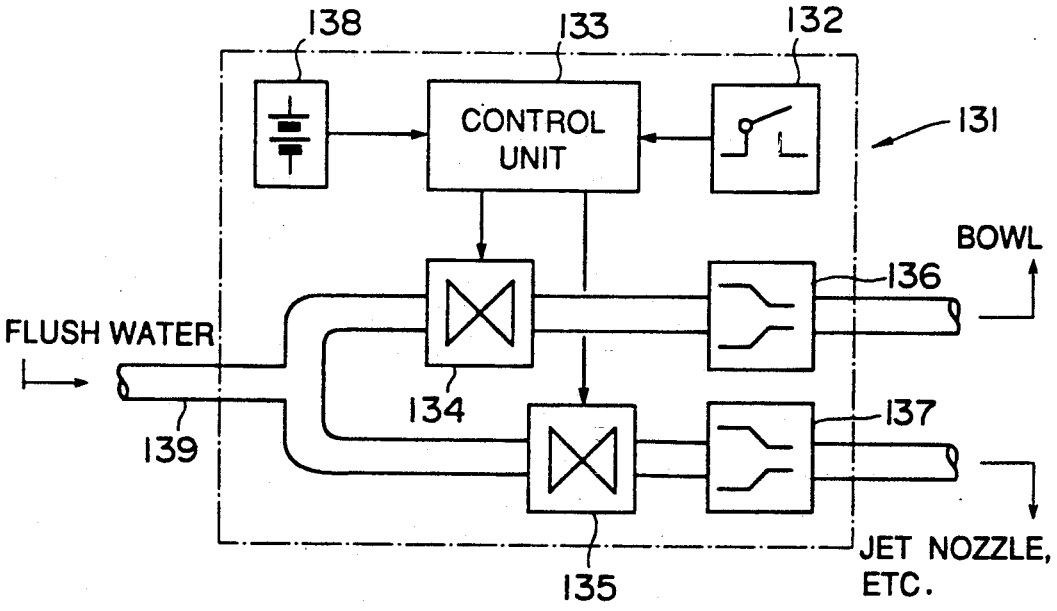
FIG. 19 is a block diagram of a further modified flush water supply system according to a fifth embodiment.

FIG. 19 shows another modified flush water supply system 131 according to the fifth embodiment.

This system 131 comprises a flush start switch 132, a control unit 133, first and second opening/closing valves 134, 135, first and second constant flow valves 136, 137, and a power source 138. A supply pipe 139 is branched into a pair of branch pipelines connected to the upstream side of the individual valves 134, 135. To the downstream side of the valves 134, 135, the first and second constant flow valves 136, 137 are connected respectively.

The first and second constant flow valves 136, 137 are different from each other in constant flow characteristic. In this embodiment, the first constant flow valve 136 permits the supply of flush water to the bowl of the toilet stool at a discharge rate of 10 l/minute, for example, and in the meantime, the second constant flow valve 137 permits the supply of flush water to the jet nozzle at a discharge rate of 20 l/minute, for example.

The control unit 133 drives the individual valves 134, 135 at a preset timing according to a flush start input.

Since the constant flow valves 136, 137 of different discharge flow characteristics are provided, one in each of two waterways 140, 141, the instant flow amount of flush water is reduced, irrespective of the water supply pressure, when supplying to the bowl. It is thereby possible to minimize the sound in supplying flush water. When supplying to the jet nozzle, flush water is supplied into the trap drainage at an adequate instant flow rate, irrespective of the water supply pressure. It is therefore possible to generate the action of siphoning with reliability.

In an alternative form, the constant flow valve may be mounted in only one of the waterways 140, 141.

As described above, according to the flush water supply system of this invention, because the discharge rate is kept substantially constant by the constant flow valves, irrespective of the water supply pressure, a predetermined amount of flush water can be supplied to the toilet stool by simply setting the time of opening the individual opening/closing valves. Therefore, it is possible to flush the toilet stool reliably by an appropriate amount of water, without adjusting the time of opening the opening/closing valves and without any excessive or insufficient supply to the toilet stool due to the temporary fluctuation of the supply pressure.

With the system according to the second and third embodiments, since flush water of amounts each corresponding to the time of opening the individual one of the opening/closing valves is supplied to a plurality of water-supply ports of the toilet stool, it is possible to supply a necessary amount of water to each of the water-supply ports. For example, it is possible to set the amount of supply to the bowl for preliminary flushing, the amount of supply to the jet nozzle and the amount of supply to the bowl for water seal to individual optimum values, thus saving water and guaranteeing an effective flushing of the toilet stool.

With the system according to the fourth embodiment, since the waterway change-over valve with the water flow stopping function is disposed on the downstream side of the constant flow valve(s), it is possible to supply predetermined amounts of flush water respectively to a plurality of water-supply ports by a reduced number of valve mechanisms, irrespective of the water supply pressure.

With the system according to the fifth embodiment, because the constant flow valves different in discharge flow can be mounted in the respective branch pipelines according to need, it is possible to set instant flow amounts independently for the individual waterways.

What is claimed is:

1. A flush water supply system for a toilet, comprising:

(a) a toilet stool having a plurality of supply ports;

(b) a pipeline means for supplying flush water to said toilet stool, said pipeline means including a passageway change-over means having a plurality of discharge ports, and a plurality of pipelines each communicating between a respective one of said dis-charge ports of said passageway change-over means and a corresponding one of said supply ports of said toilet stool;

(c) a constant flow valve mounted in said pipeline means for obtaining a predetermined amount of dis-charge flow, the constant flow valve including a water passage and means for adjusting the cross-sectional area of the water passage after the water supply pressure reaches a predetermined value;

(d) at least one electrically operable valve mounted in said pipeline means;

(e) a starting-of-flush input means for accepting an input for starting the supply of flush water; and (f) a control means for driving said passageway change-over means and said electrically operable valve in response to an input for starting the supply of flush water.

2. A flush water supply system according to claim 1, in which said toilet stool includes a bowl, a trap drainage, a rim formed on and along an upper peripheral edge of said bowl and having watershooting holes and a waterway leading to said watershooting holes, and a rim water-supply chamber communicating with said waterway of said rim, said supply ports of said toilet stool including a first supply port dis-posed at said rim water-supply chamber, and a second supply port disposed at a bottom of said bowl, said plurality of pipelines including a first pipeline connected to said first supply port, and a second pipeline connected to said second supply port.

3. A flush water supply system according to claim 2, in which said second supply port is a jet nozzle pointing to an inlet of said trap drainage.

4. A flush water supply system according to claim 3, in which said control means is operable to open firstly said first pipeline for a predetermined period of time, and then said second pipeline for a predetermined period of time.

5. A flush water supply system according to claim 1, in which said discharge ports of said passageway change-over means includes a normally open first discharge port, and a normally closed second discharge port.

6. A flush water supply system according to claim 5, in which said control means is operable to open said electrically operable valve for a predetermined period of time and, during said predetermined period of time, to drive said passageway change-over means to make a change-over between said discharge ports.

7. A flush water supply system according to claim 1, in which said toilet stool includes a bowl, a trap drainage, a rim formed on and along an upper peripheral edge of said bowl and having watershooting holes and a waterway leading to said watershooting holes, and a rim water-supply chamber communicating with said waterway of said rim, said supply ports of said toilet stool including a first supply port dis-posed at said rim water-supply chamber, and a second supply port disposed at said trap drainage, said first and second discharge ports of said passageway change-over means being respectively connected to said first and second supply ports.

8. A flush water supply system according to claim 7, in which said second supply port is a shower mouth piece.

9. A flush water supply system according to claim 1, in which said electrically operable valve is disposed in said passageway change-over means to open and close the flow passageway.

10. A flush water supply system according to claim 9, in which said toilet stool includes a bowl, a trap drainage, a rim formed on and along an upper peripheral edge of said bowl and having watershooting holes and a waterway leading to said watershooting holes, and a rim water-supply chamber communicating with said waterway of said rim, said supply ports of said toilet stool including a first supply port dis-posed at said rim water-supply chamber, and a second supply port disposed at a bottom of said bowl, said plurality of pipelines including a first pipeline connected to said first supply port, and a second pipeline connected to said second supply port.

11. A flush water supply system according to claim 10, in which said second supply port is a jet nozzle pointing to an inlet of said trap drainage.

12. A flush water supply system according to claim 11, in which said control means is operable to open firstly said first pipeline for a predetermined period of time, and then said second pipeline for a predetermined period of time.

13. A flush water supply system according to claim 9, in which said toilet stool includes a bowl, a trap drainage, a rim formed on and along an upper peripheral edge of said bowl and having watershooting holes and a waterway leading to said watershooting holes, and a rim water-supply chamber communicating with said waterway of said rim, said supply ports of said toilet stool including a first supply port dis-posed at said rim water-supply chamber, and a second supply port disposed at said trap drainage, said first and second discharge ports of said passageway change-over means being respectively connected to said first and second supply ports.

14. A flush water supply system according to claim 13, in which said second supply port is a shower mouth piece.

15. A flush water supply system according to claim 9, further comprising means for differentiating the flows of said plurality of pipelines from one another.

16. A flush water supply system according to claim 15, in which said differentiating means is composed of a plurality of constant flow valves mounted one in each of said pipelines having a different discharge flows.

17. A flush water supply system according to claim 15, in which said differentiating means is a constant flow valve mounted in one of said pipelines.

18. A flush water supply system according to claim 9, in which said valves are self-maintaining valves.

19. A flush water supply system according to claim 18, in which said self-maintaining valves are battery-operated.

20. A flush water supply system according to claim 8, further comprising:

means for differentiating the flows of said plurality of pipelines from one another.

21. A flush water supply system according to claim 20, in which said differentiating means is composed of a plurality of constant flow valves mounted one in each of said pipelines having a different discharge flows.

22. A flush water supply system according to claim 20, in which said differentiating means is a constant flow valve mounted in one of said pipelines.

23. A flush water supply system according to claim 1, in which said valves are self-maintaining valves.

24. A flush water supply system according to claim 23, in which said self-maintaining valves are battery-operated.

25. A flush water supply system according to claim 1, in which said constant flow valve and said electrically operable valve are both disposed upstream of said passageway change over means.

* * * * *

UNITED STATES PATENT AND TRADEMARK OFFICE

CERTIFICATE OF CORRECTION

PATENT NO. : 5,109,550

DATED : May 5,. 1992

INVENTOR(S) : Makita et al.

It is certified that error appears in the above-identified patent and that said Letters Patent is hereby corrected as shown below:

Column 4, line 36 insert --13-- after the word "Fig."

Signed and Sealed this

Twenty-first Day of September, 1993

Bruce Lehman

*Attest:*

BRUCE LEHMAN

*Attesting Officer*

*Commissioner of Patents and Trademarks*